US010012000B2

(12) United States Patent
Yoo

(10) Patent No.: US 10,012,000 B2
(45) Date of Patent: Jul. 3, 2018

(54) COLLAPSIBLE WORK PLATFORM

(71) Applicant: Thomas Yoo, Garden Grove, CA (US)

(72) Inventor: Thomas Yoo, Garden Grove, CA (US)

( * ) Notice: Subject to any disclaimer, the term of this patent is extended or adjusted under 35 U.S.C. 154(b) by 0 days.

(21) Appl. No.: 15/252,107

(22) Filed: Aug. 30, 2016

(65) Prior Publication Data

US 2017/0183881 A1 Jun. 29, 2017

(30) Foreign Application Priority Data

Dec. 29, 2015 (KR) ..... 20-2015-0008594 U

(51) Int. Cl.

| | |
|---|---|
| ***E04G 1/34*** | (2006.01) |
| ***E04G 1/30*** | (2006.01) |
| ***E04G 5/16*** | (2006.01) |
| ***E04G 1/22*** | (2006.01) |
| ***E06C 1/39*** | (2006.01) |

(52) U.S. Cl.

CPC ..... *E04G 1/34* (2013.01); *E04G 1/22* (2013.01); *E04G 1/30* (2013.01); *E04G 5/16* (2013.01); *E06C 1/39* (2013.01); *E04G 2001/305* (2013.01)

(58) Field of Classification Search

CPC . E06C 1/387; E06C 1/39; E06C 1/393; E06C 1/32; E06C 1/38; E06C 1/383; A47C 12/00; E04G 1/34; E04G 1/30; E04G 5/16; E04G 1/22; E04G 2001/305; E04G 1/28; E04G 2001/302

See application file for complete search history.

(56) References Cited

U.S. PATENT DOCUMENTS

| | | | | |
|---|---|---|---|---|
| 826,582 A * | 7/1906 | Laird | E06C 1/393 | 182/124 |
| 864,898 A * | 9/1907 | Koues | E06C 1/383 | 182/161 |
| 2,592,912 A * | 4/1952 | Knipper | A47C 12/02 | 182/33 |
| 3,554,318 A * | 1/1971 | Knight | E06C 1/32 | 182/163 |
| 4,004,652 A * | 1/1977 | Laboy-Alvarado | E01D 15/124 | 182/1 |
| 4,053,028 A * | 10/1977 | Loix | E06C 1/20 | 182/1 |
| 4,519,476 A * | 5/1985 | Alimbau Marques | E06C 1/393 | 182/151 |

(Continued)

*Primary Examiner* — Daniel P Cahn

(74) *Attorney, Agent, or Firm* — John K. Park; Park Law Firm

(57) ABSTRACT

A collapsible work platform includes toprails engaging fixedly to a platform, backrails engaging the toprails pivotally through a hinge at an end portion of the pair of toprails, frontrails engaging the toprails pivotally through a hinge at the other portion of the toprails, link bars engaging the toprails pivotally, a footstep engaging the link bars and the frontrails pivotally, and braces engaging the backrails and the frontrails, and the toprails pivotally through hinges. Each of latching plates having a latching portion engages fixedly the end portions of the backrails and the frontrails maintaining the deployed state by the braces. Each of stopper blocks engage protrudingly an inner side and an outer side of one end and the other end of the toprails, so that the latching portion of the latching plate contacts and engages fixedly and the backrails and the frontrails are not deployed further beyond a certain point.

2 Claims, 5 Drawing Sheets

(56) References Cited

U.S. PATENT DOCUMENTS 4,699,246 A * 10/1987 Wang ..... E06C 1/39 182/24
5,368,126 A * 11/1994 Woodward ..... E04G 1/20 182/118
5,720,362 A * 2/1998 Denkins ..... B25H 1/04 182/182.2
5,722,507 A * 3/1998 Kain ..... E06C 1/393 182/104
5,746,288 A * 5/1998 O'Neal ..... E04G 1/34 182/118
D536,799 S * 2/2007 Freitas ..... D25/66
D642,283 S * 7/2011 Eriksson ..... D25/66
8,113,316 B2 * 2/2012 Sward ..... G01N 33/497 108/62
8,186,480 B1 * 5/2012 Yoakum, Jr. ..... E06C 1/39 182/118
9,320,955 B2 * 4/2016 Aral Diaz ..... A63B 17/00
9,357,842 B2 * 6/2016 Gu ..... A47B 85/06
9,404,305 B1 * 8/2016 Messick ..... E06C 7/16
D776,826 S * 1/2017 Foley ..... E04G 1/34 D25/66
9,752,334 B2 * 9/2017 Foley ..... E04G 1/34
2004/0238278 A1 * 12/2004 Gibson ..... E04G 1/28 182/129
2004/0238280 A1 * 12/2004 Gibson ..... E04G 1/28 182/153
2006/0169539 A1 * 8/2006 Grebinoski ..... E04G 1/15 182/223
2007/0261916 A1 * 11/2007 Sward ..... G01N 33/497 182/129
2009/0078165 A1 * 3/2009 Tseng ..... A47B 3/0912 108/6
2009/0095567 A1 * 4/2009 Rinna ..... E04G 1/30 182/124
2009/0133959 A1 * 5/2009 Eriksson ..... E04G 1/34 182/118
2010/0071996 A1 * 3/2010 Huang ..... E04G 1/34 182/118
2011/0056764 A1 * 3/2011 Cross ..... E06C 1/32 182/27
2013/0192925 A1 * 8/2013 Chitayat ..... A47C 12/00 182/152
2015/0027810 A1 * 1/2015 Yoo ..... E06C 1/393 182/27
2017/0241204 A1 * 8/2017 Moss ..... E06C 7/182
2017/0275899 A1 * 9/2017 Woodward ..... E04G 1/30
2018/0085912 A1 * 3/2018 Cindric ..... B25H 1/04

* cited by examiner

-- Prior Art --

-- Prior Art --

COLLAPSIBLE WORK PLATFORM

FIELD OF TECHNOLOGY

The invention relates to a work platform, more specifically to a collapsible work platform, which is collapsible compactly so as to be carry and store conveniently, the height of which can be adjusted.

BACKGROUND OF THE INVENTION

In general, the work platform for works such as paint, wallpaper, etc. includes a horizontal platform so that the user can move around on it and perform some works at a high location.

Here, there are many types of conventional work platforms, and the one illustrated in FIGS. 1 and 2 includes a platform (10) connected with hinges (20) so as to be folded, leg members (30) engaging correspondingly with both ends of the platform (10) pivotally about the hinge (40), and a connecting rod (50) installed between the leg members (30) and the platform (10) so as to maintain a deployed state of the leg members (30).

Such a conventional work platform rotates the leg members (30) outwards about the hinge (40) in a deployed state of the platform (10) connected to the hinges (20), engages one side portion and the other side portion of the connecting rod (50) between the leg member (30) and the leg member (30), and prevents the leg member (30) rotated outwards from the platform (10) about the hinge (40) from rotating inwards from the platform (30), maintaining the standing state stably.

On the other hand, in order to fold to store or carry, the connecting rod (50) is detached from the leg member (30), and then the leg member (30) is folded inwards and the platform (10) is folded upwards.

However, in such a conventional work platform, since the platform (10) is folded upwards and the leg members (30) are folded outwards, the leg members (30) protrude outwards from the platform (10) and therefore the volume of the work platform gets larger and is not convenient to carry.

On the other hand, if the platform (10) is applied with too much of load or the connecting rod (50) is damaged, during an operation, the connecting rod (50) may be disconnected, disengaged from the leg member (30), and damaged, and also the platform (10) may be folded due to the break of the hinges (20), and therefore the user may be injured.

Also, the above work platform could not be adjusted with the height of the leg members (30), and therefore it was inconvenient to use a several work platforms with different heights for the workplace.

PRIOR ARTS

Korean Patent Application Publication 10-2006-0109222.

SUMMARY OF THE INVENTION

Problems to Solve

The present invention contrives to solve the disadvantages of the prior art, and is to provide a work platform, which has a pair of backrails and a pair of frontrails to be folded at an outer side and an inner side of a pair of toprails, respectively, so as to be overlapped with the pair of toprails, so that the backrails and the frontrails do not protrude outwards from the platform and the volume is minimized, enabling storing and carrying facilitated.

Another object of the invention is to provide a collapsible work platform, which the length of the backrails and the frontrails can be varied according to the necessity of the user so as to adjust the height of the platform.

Solutions to Problem

A collapsible work platform comprising:

a pair of toprails (200) engaging fixedly to each of front and rear side of a platform (100);

a pair of backrails (300), each of which having an upper end engaging one corresponding outer side of the pair of toprails pivotally through a hinge (H) at an end portion of the pair of toprails;

a pair of frontrails (400), each of which having an upper end engaging one corresponding inner side of the pair of toprails pivotally through a hinge (H) at the other portion of the pair of toprails, which the pair of backrails engage at the outer sides of the pair of toprails;

a pair of link bars (500), each of which having an upper end engaging the pair of toprails pivotally through a hinge with a specific interval from the pair of frontrails;

a footstep (600) having an end portion engaging the pair of link bars pivotally through a hinge and the other end portion engaging the pair of frontrails pivotally; and two pairs of braces (700) having an end portion and the other end portion, each of which engaging the pair of backrails and the pair of frontrails, respectively, and the pair of toprails pivotally through hinges, so that the pair of frontrails and the pair of backrails engaging with the footstep be folded and also the pair of backrails and the pair of frontrails maintain a deployed state, each of a pair of latching plates (800) having a latching portion (810) engages fixedly the end portions of the pair of backrails and the pair of frontrails maintaining the deployed state by the two pairs of braces, and each of a pair of stopper blocks (900) engage protrudingly an inner side and an outer side of one end and the other end of the pair of toprails, so that the latching portion of the latching plate contacts and engages fixedly and the pair of backrails and the pair of frontrails are not deployed further beyond a certain point.

On the other hand, the pair of frontrails (400) comprise a pair of upper frontrail portions having an upper portion engaging the other portion of the pair of toprails pivotally through a hinge (H) and a pair of lower frontrail portions installed so as to be inserted and deployed in a telescoping manner in the pair of upper frontrail portions.

Also, a locking button (L) is provided in the footstep installed in the pair of upper frontrail portions, so as to generate a locking force and maintain a state that the pair of lower frontrail portions are inserted into lower portions of the pair of upper frontrail portions, or so as to relieve the locking force and deploying the pair of lower frontrail portions out of the pair of upper frontrail portions.

On the other hand, the pair of backrails (300) comprise a pair of upper backrail portions having an upper portion engaging the other portion of the pair of toprails pivotally through a hinge (H) and a pair of lower backrail portions installed so as to be inserted and deployed in a telescoping manner in the pair of upper backrail portions, and a cross bar (C) is provided in the pair of upper backrail portions and a locking button (L) is provided in the cross bar, so as to generate a locking force and maintain a state that the pair of lower backrail portions are inserted into lower portions of the pair of upper backrail portions, or so as to relieve the locking force and deploying the pair of lower backrail portions out of the pair of upper backrail portions.

Effects of Invention

The collapsible work platform according to the invention enables that if the frontrails and the backrails are rotated about the hinge so as to be folded, the backrails and the frontrails maintain the folded state at the inner side and the outer side of the toprails, respectively, without being interfered by each other, and therefore the volume is minimized for storing and carrying conveniently. And, if deploying the collapsible work platform for a usage, the four braces are straightened linearly at the same time, making a triangular structure connecting the toprails, the frontrails, and the backrails, respectively, so as to prevent shaking of the platform. Here, the latching plates with latching portions engaging fixedly to the top end portions of the frontrails and the backrails engage the stopper blocks engaging protrudingly to the toprails, blocking the rotation of the backrails and the frontrails, so as to maximize the stability of the platform.

On the other hand, according to the invention, also when the user working on a platform works a couple of workplaces with different heights, it is very effective because the user can change the length of the backrails and the frontrails according to the work environment.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Referring to the figures, the embodiments of the invention are described in detail.

Figure 2:
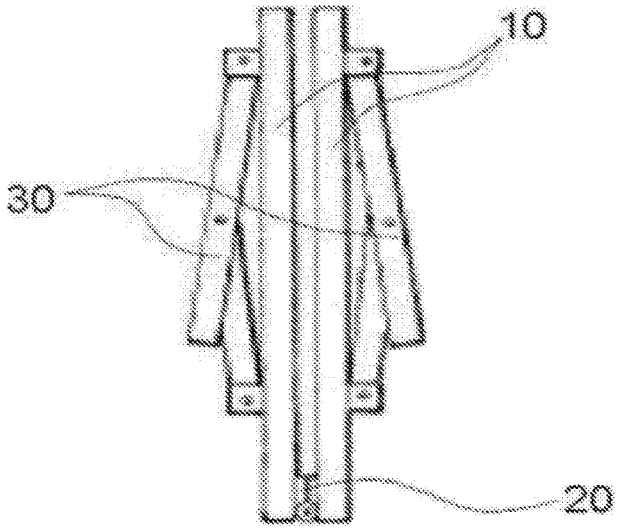
FIG. 2 is a front view showing a folded state of a conventional platform ladder.
Figure 1:
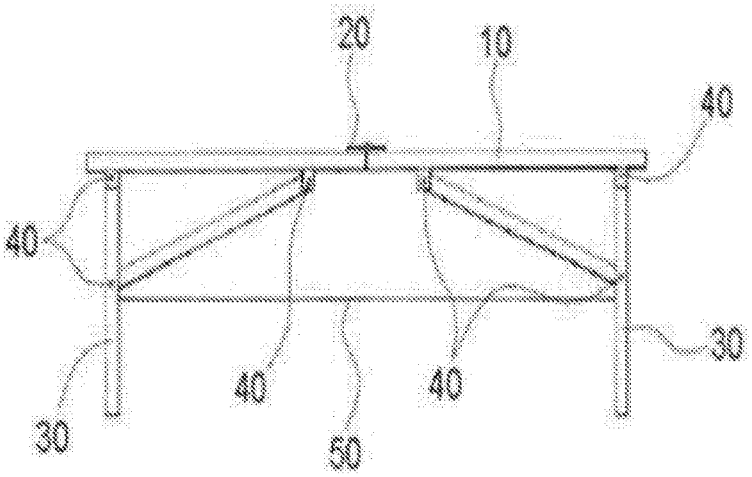
FIG. 1 is a front view showing a deployed state of a conventional platform ladder.
Figure 3:
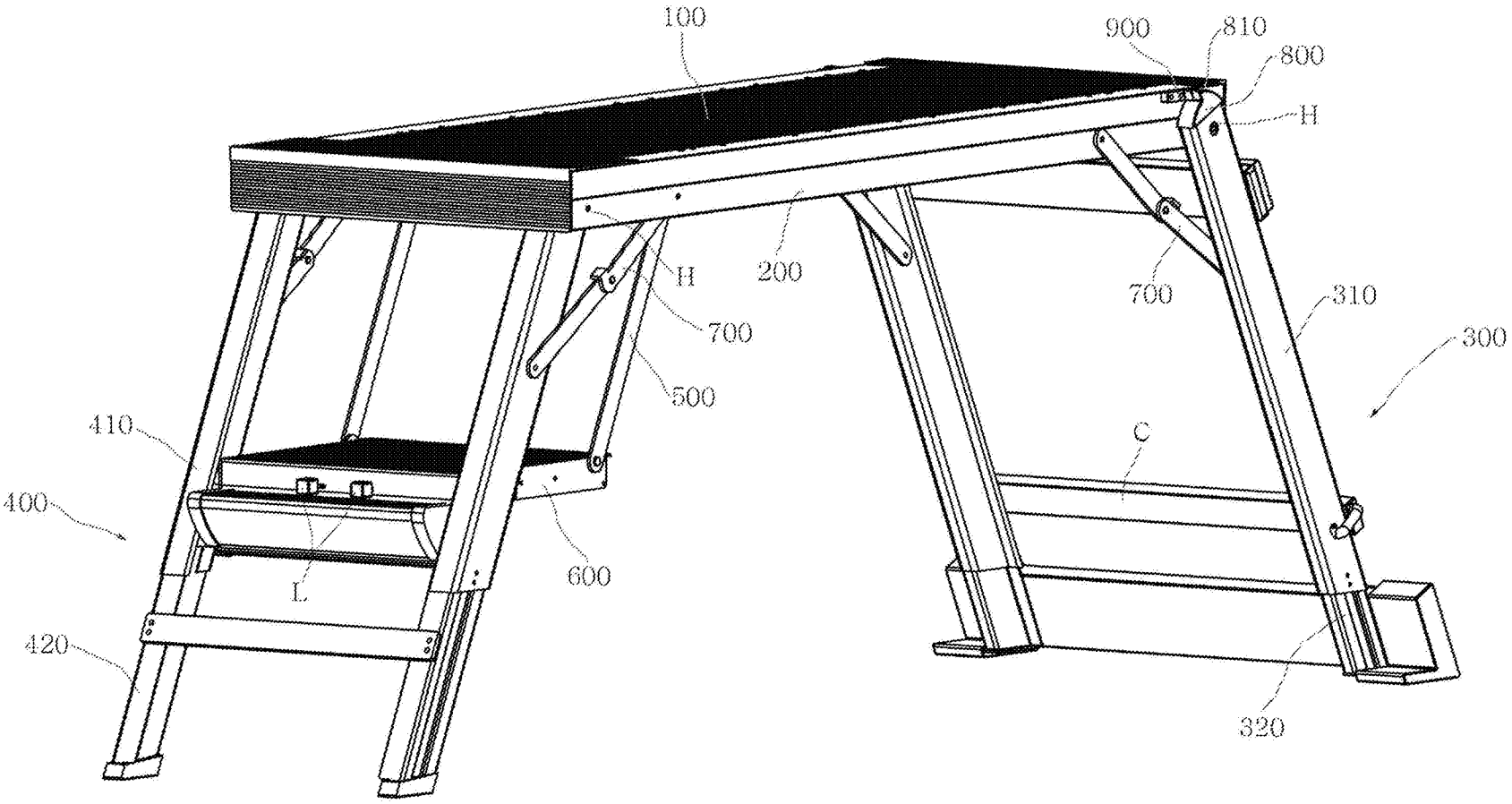
FIG. 3 is a perspective view showing a deployed state of a collapsible work platform according to an embodiment of the invention.
Figure 4:
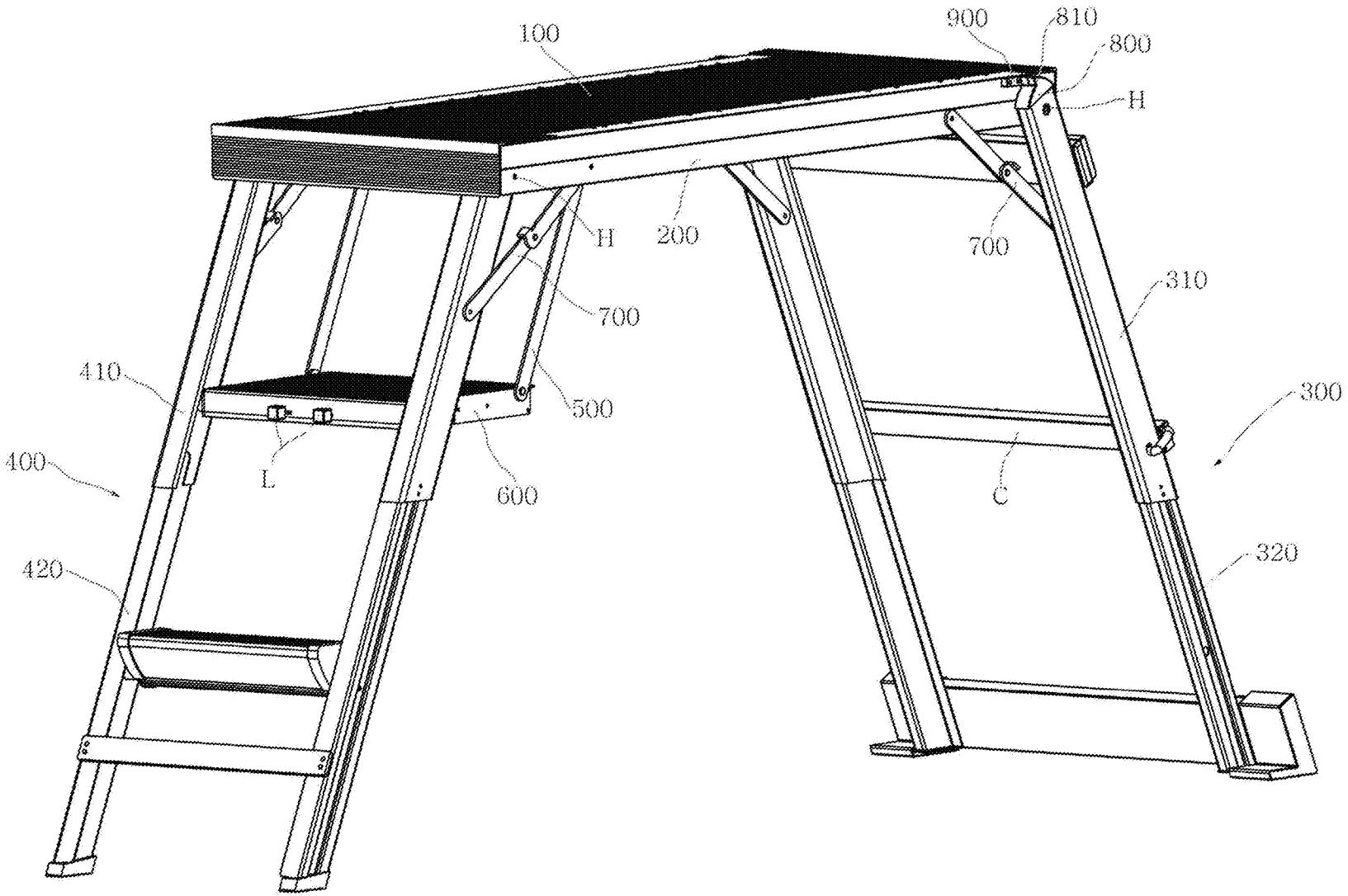
FIG. 4 is a perspective view showing a state that a pair of lower frontrail portions and a pair of lower backrail portions are pushed out of a pair of upper frontrail portions and a pair of upper backrail portions so as to lengthen the backrails and the frontrails.
Figure 5:
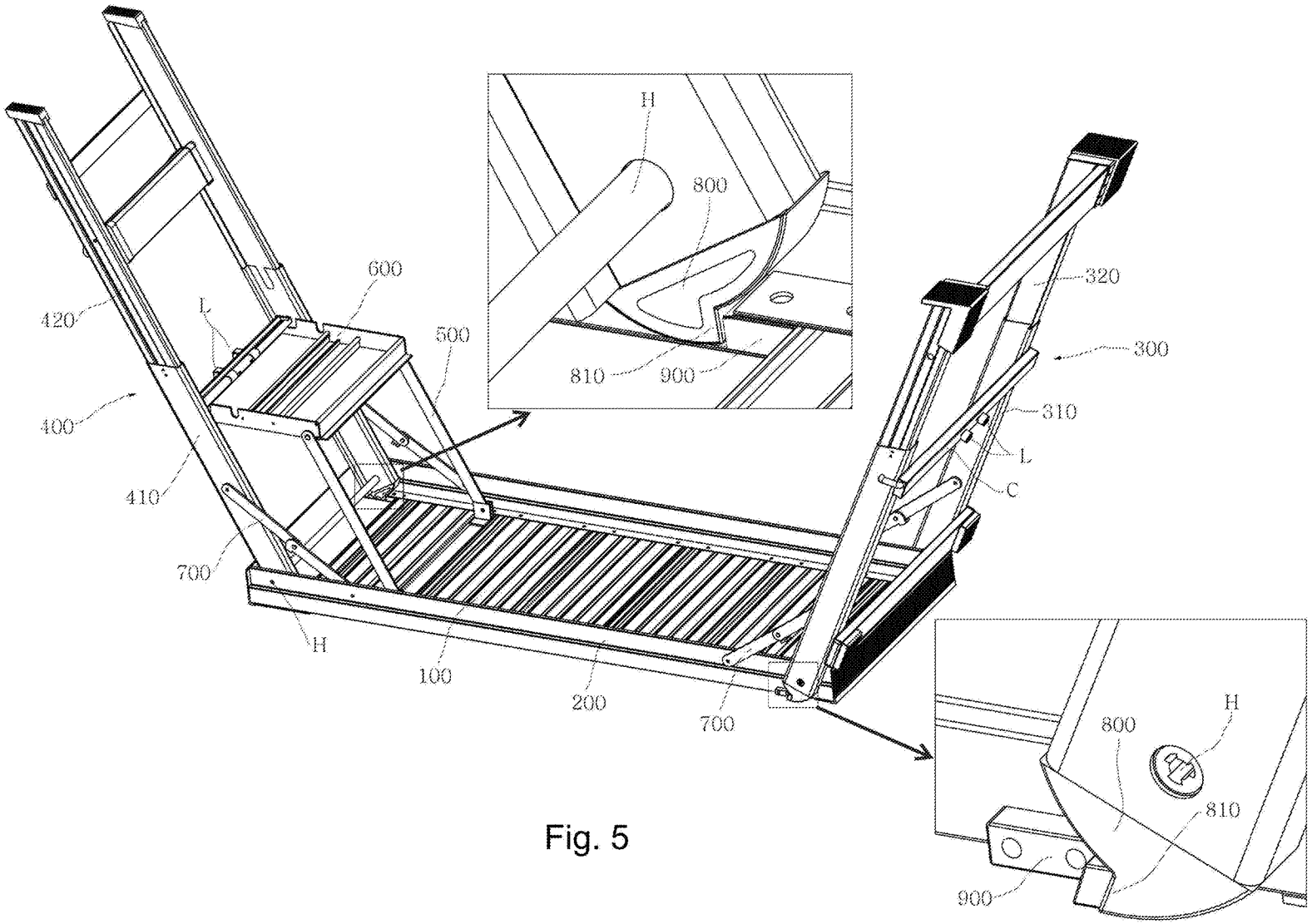
FIG. 5 is a perspective view showing the collapsible work platform of FIG. 4 upside down.
Figure 6:
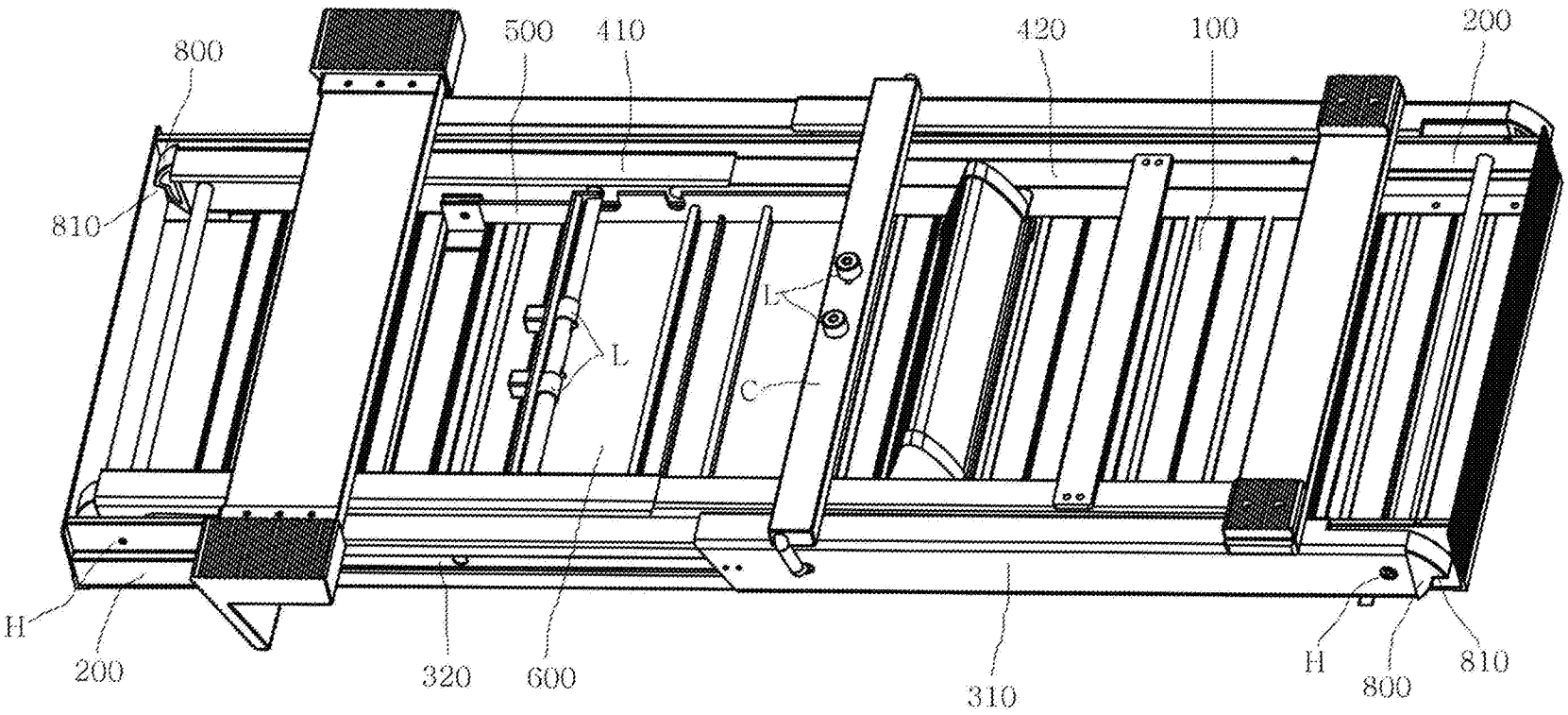
FIG. 6 is a perspective view showing a folded state of a collapsible work platform according to an embodiment of the invention.

FIG. 3 is a perspective view showing a deployed state of a collapsible work platform according to an embodiment of the invention, FIG. 4 is a perspective view showing a state that a pair of lower frontrail portions and a pair of lower backrail portions are pushed out of a pair of upper frontrail portions and a pair of upper backrail portions so as to lengthen the backrails and the frontrails, FIG. 5 is a perspective view showing the collapsible work platform of FIG. 4 upside down, and FIG. 6 is a perspective view showing a folded state of a collapsible work platform according to an embodiment of the invention.

As shown in FIGS. 3 through 6, a collapsible work platform comprising a pair of toprails (200) engaging fixedly to each of front and rear side of a platform (100), a pair of backrails (300), each of which having an upper end engaging one corresponding outer side of the pair of toprails (200) pivotally through a hinge (H) at an end portion of the pair of toprails (200), a pair of frontrails (400), each of which having an upper end engaging one corresponding inner side of the pair of toprails (200) pivotally through a hinge (H) at the other portion of the pair of toprails (200), which the pair of backrails (300) engage at the outer sides of the pair of toprails (200), a pair of link bars (500), each of which having an upper end engaging the pair of toprails (200) pivotally through a hinge with a specific interval from the pair of frontrails (400), a footstep (600) having an end portion engaging the pair of link bars pivotally through a hinge and the other end portion engaging the pair of frontrails (400) pivotally, and two pairs of braces (700) having an end portion and the other end portion, each of which engaging the pair of backrails and the pair of frontrails, respectively, and the pair of toprails (200) pivotally through hinges, so that the pair of frontrails (400) and the pair of backrails (300) engaging with the footstep (600) be folded and also the pair of backrails (300) and the pair of frontrails (400) maintain a deployed state.

On the other hand, each of a pair of latching plates (800) having a latching portion (810) engages fixedly the end portions of the pair of backrails (300) and the pair of frontrails (400) maintaining the deployed state by the two pairs of braces (700), and each of a pair of stopper blocks (900) engage protrudingly an inner side and an outer side of one end and the other end of the pair of toprails (200), so that the latching portion (810) of the latching plate (800) contacts and engages fixedly and the pair of backrails (300) and the pair of frontrails (400) are not deployed further beyond a certain point.

Also, the pair of frontrails (400) comprise a pair of upper frontrail portions (410) having an upper portion engaging the other portion of the pair of toprails (200) pivotally through a hinge (H) and a pair of lower frontrail portions (420) installed so as to be inserted and deployed in a telescoping manner in the pair of upper frontrail portions (410).

Also, a locking button (L) is provided in the footstep (600) installed in the pair of upper frontrail portions (410), so as to generate a locking force and maintain a state that the pair of lower frontrail portions (420) are inserted into lower portions of the pair of upper frontrail portions (410), or so as to relieve the locking force and deploying the pair of lower frontrail portions (420) out of the pair of upper frontrail portions (410).

On the other hand, the pair of backrails (300) comprise a pair of upper backrail portions (310) having an upper portion engaging the other portion of the pair of toprails (200) pivotally through a hinge (H) and a pair of lower backrail portions (320) installed so as to be inserted and deployed in a telescoping manner in the pair of upper backrail portions (310), and a cross bar (C) is provided in the pair of upper backrail portions (310) and a locking button (L) is provided in the cross bar (C), so as to generate a locking force and maintain a state that the pair of lower backrail portions (320) are inserted into lower portions of the pair of upper backrail portions (310), or so as to relieve the locking force and deploying the pair of lower backrail portions (320) out of the pair of upper backrail portions (310).

The invention as shown in the above has the top portions of the pair of backrails (300) engaging pivotally through a hinge (H) one side portions of the pair of toprails (200) combined fixedly to the front side and the rear side of the platform (100) respectively, and to the other end portions of the pair of toprails (200) engage the top portion of the pair of frontrails (400) pivotally through a hinge (H), forming a folding hinge.

Here, in the case that the top portions of the pair of backrails (300) engage the outer side portions of the pair of toprails (200) pivotally through a hinge (H), the pair of frontrails (400) positioned in a direction facing the pair of backrails (300) have the top portions engage the inner side portions of the pair of toprails (200).

If rotating the pair of backrails (300) and the pair of frontrails (400) about the hinge (H), the pair of frontrails (400) and the pair of backrails (300) do not interfere each other and maintain the state folded at the inner and outer sides of the platform (100).

On the other hand, in the case of using it by deploying the pair of backrails (300) and the pair of frontrails (400) folded and positioned at the inner and outer side portions of the platform (100), the user may rotate the pair of backrails (300) first about the hinge (H).

Here, in a state that the pair of backrails (300) rotates until the latching portions (810) of the pair of latching plates (800) engaging the end portions of the pair of backrails (300) are latched to the stopper block (900) engaging the one side portions of the pair of toprails (200), the pair of braces (700) are unfolded or straightened linearly and support the pair of backrails (300) and the pair of toprails (200) in the triangular forms, so as to make the deployed state solid and stable.

After deploying the pair of backrails (300), the pair of frontrails (400) are rotated about the hinge (H).

Here, in a state that the pair of frontrails (400) rotates until the latching portions (810) of the pair of latching plates (800) engaging the end portions of the pair of frontrails (400) are latched to the stopper block (900) engaging the one side portions of the pair of toprails (200), the pair of braces (700) are unfolded or straightened linearly and support the pair of frontrails (400) and the pair of toprails (200) in the triangular forms, so as to make the deployed state and maintain the state that the platform (100) is away from the floor by the length of the pair of backrails (300) and the pair of frontrails (400).

On the other hand, in a case that the user wants to increase the height of the platform (100), who deploys the pair of backrails (300) and the pair of frontrails (400) and performs works on the platform (100), by the user's operating the locking button (L) installed in the cross bar (C) and the locking button (L) installed in the footstep (600) for extending the length of the pair of backrails (300) and the pair of frontrails (400), the locking force of the pair of lower backrail portions (320) maintaining the state of being retracted in the pair of upper backrail portions (310) of the pair of backrails (300) and the locking force of the pair of lower frontrail portions (420) maintaining the state of being retracted in the pair of upper frontrail portions (410) of the pair of frontrails (400) are relieved and they are extracted from the pair of upper backrail portions (310) and the pair of upper frontrail portions (410) respectively, extending the length of the pair of backrails (300) and the pair of frontrails (400).

Here, the platform (100) gets heightened further from the floor as much as the length of the pair of backrails (300) and the pair of frontrails (400) is extended.

Thus, the user who performs works on the platform (100) can work in various workplaces with different heights.

REFERENCE NUMERALS

100: platform
200: toprails
300: backrails
310: upper backrail portions
320: lower backrail portions
400: frontrails
410: upper frontrail portions
420: lower frontrail portions
500: link bars
600: footstep
700: braces
800: latching plates
810: latching portions
900: stopper block
C: cross bar
H: hinge
L: locking button

What is claimed is:

1. A collapsible work platform comprising:

a platform (100);

a pair of top rails (200) engaging fixedly to each of a front side and a rear side of the platform;

a pair of back rails (300), each of which having an upper end engaging one corresponding outer side of the pair of top rails pivotally through a first hinge (H) at an end portion of the pair of top rails respectively, the pair of back rails engages at the outer sides of the pair of top rails respectively;

a pair of front rails (400), each of which having an upper end engaging one corresponding inner side of the pair of top rails pivotally through a second hinge (H) at another end portion of the pair of top rails respectively;

a pair of link bars (500), each of which having an upper end engaging the pair of top rails pivotally through a third hinge with a specific interval from the pair of front rails respectively;

a footstep (600) having an end portion engaging each of the pair of link bars pivotally through a fourth hinge respectively, and the footstep having another end portion engaging the pair of front rails pivotally;

two pairs of braces (700), each of which having an end portion and another end portion, each of a first pair of said two pairs of braces engaging the pair of back rails respectively and the pair of top rails respectively pivotally through a first pair of sixth hinges, each of a second pair of said two pairs of braces engaging the pair of front rails respectively and the pair of top rails respectively pivotally through a second pair of sixth hinges, each of said hinges and braces configured so that the pair of back rails and the pair of front rails engaging with the footstep are configured to be folded so that each of the rails are substantially parallel to one another as the braces are folded, and so that the pair of back rails and the pair of front rails are configured to maintain a deployed state when the braces are unfolded as the back rails and front rails are unfolded with respect to the top rails;

each of a pair of latching plates (800) having a latching portion (810) engaging fixedly with the upper ends of the pair of back rails and the upper ends of the pair of front rails respectively, each of the latching plates configured to maintain the deployed state with the two pairs of braces unfolded;

two pairs of stopper blocks (900), a first pair of said two pairs of stopper blocks engaging and protruding from the inner side of said another end portion of the top rails respectively, a second pair of said two pairs of stopper blocks engaging and protruding from the outer side of said end portion of the top rails respectively, the stopper blocks configured so that the latching portion of the pair of latching plates contacts and engages fixedly with the pair of back rails and the pair of front rails to maintain the deployed state, and the stoppers blocks are configured to prevent the pair of back rails and the pair of front rails from rotating further beyond a certain position which maintains the deployed state, the deployed state being when the platform and footstep are substantially horizontal and elevated above ground by the front and back rails in order to allow a worker to ascend onto the platform.

2. The collapsible work platform of claim 1, wherein the pair of front rails (400) comprises:

a pair of upper front rail portions having said upper end of said pair of front rails respectively engaging said another end portion of the pair of top rails pivotally through the second hinges (H); and a pair of lower front rail portions inserted and deployed in a telescoping manner in the pair of upper front rail portions, wherein a locking button (L) is provided in the footstep installed in the pair of upper front rail portions, configured to generate a locking force to maintain a position of the pair of lower front rail portions inserted into lower portions of the pair of upper front rail portions, or configured to relieve the locking force to deploy the pair of lower front rail portions away from the pair of upper front rail portions, wherein the pair of back rails (300) comprises:

a pair of upper back rail portions having said upper end of the pair of back rails respectively engaging the end portion of the pair of top rails pivotally through the first hinge (H); and a pair of lower back rail portions inserted and deployed in a telescoping manner in the pair of upper back rail portions, wherein a cross bar (C) is provided in the pair of upper back rail portions and a second locking button (L) is provided in the cross bar, configured to generate a second locking force to maintain a position of the pair of lower back rail portions inserted into lower portions of the pair of upper back rail portions, or configured to relieve the second locking force to deploy the pair of lower back rail portions away from the pair of upper back rail portions.

* * * * *